US009941039B2

(12) United States Patent
Okamoto et al.

(10) Patent No.: US 9,941,039 B2
(45) Date of Patent: Apr. 10, 2018

(54) SOFT MAGNETIC MEMBER, REACTOR, POWDER FOR DUST CORE, AND METHOD OF PRODUCING DUST CORE

(71) Applicant: TOYOTA JIDOSHA KABUSHIKI KAISHA, Toyota-shi, Aichi-ken (JP)

(72) Inventors: Daisuke Okamoto, Toyota (JP); Kiyotaka Onodera, Toyota (JP); Shinjiro Saigusa, Toyota (JP); Kohei Ishii, Nagoya (JP); Masashi Ohtsubo, Nagakute (JP); Junghwan Hwang, Nagakute (JP); Masaaki Tani, Nagakute (JP); Takeshi Hattori, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 259 days.

(21) Appl. No.: 14/737,876

(22) Filed: Jun. 12, 2015

(65) Prior Publication Data

US 2015/0364235 A1 Dec. 17, 2015

(30) Foreign Application Priority Data

Jun. 13, 2014 (JP) ..... 2014-122429

(51) Int. Cl.
*H01F 17/04* (2006.01)
*H01F 27/24* (2006.01)
(Continued)

(52) U.S. Cl.
CPC ..... *H01F 1/24* (2013.01); *B22F 1/02* (2013.01); *C22C 33/0257* (2013.01);
(Continued)

(58) Field of Classification Search
USPC ..... 336/221, 212, 83, 234
See application file for complete search history.

(56) References Cited

U.S. PATENT DOCUMENTS

2003/0024607 A1* 2/2003 Takemoto ..... H01F 1/14791 148/309
2008/0078474 A1 4/2008 Naito et al.
(Continued)

FOREIGN PATENT DOCUMENTS

EP 2434502 A1 3/2012
EP 2555210 A1 2/2013
(Continued)

OTHER PUBLICATIONS

De Vicente J et al., "Permeability measurements in cobalt ferrite and carbonyl iron powders and suspensions", Journal of Magnetism and Magnetic Materials, Elsevier Science Publishers, Amsterdam, NL, vol. 1, 251 No. 1, Oct. 2002, pp. 100-108, XP004389976, ISSN: 0304-8853, DOI: 10.1016/S0304-8853(02)00484-5 (see, p. 105, col. 1, paragraph 2—col. 2, paragraph 1; and Fig. 8.

*Primary Examiner* — Elvin G Enad
*Assistant Examiner* — Kazi Hossain
(74) *Attorney, Agent, or Firm* — Sughrue Mion, PLLC

(57) ABSTRACT

A soft magnetic member is formed such that, when a differential relative permeability in an applied magnetic field of 100 A/m is represented by a first differential relative permeability μ'L, and when a differential relative permeability in an applied magnetic field of 40 kA/m is represented by a second differential relative permeability μ'H, a ratio of the first differential relative permeability μ'L to the second differential relative permeability μ'H satisfies a relationship of μ'L/μ'H≤10, and a magnetic flux density in an applied magnetic field of 60 kA/m is 1.15 T or higher.

2 Claims, 9 Drawing Sheets

(51) Int. Cl.

| | |
|---|---|
| ***H01F 1/24*** | (2006.01) |
| ***H01F 41/02*** | (2006.01) |
| ***H01F 1/147*** | (2006.01) |
| ***H01F 1/33*** | (2006.01) |
| ***B22F 1/02*** | (2006.01) |
| ***C22C 33/02*** | (2006.01) |
| *H01F 3/08* | (2006.01) |
| *H01F 27/255* | (2006.01) |

(52) U.S. Cl.
CPC ..... *C22C 33/0264* (2013.01); *H01F 1/14791* (2013.01); *H01F 1/33* (2013.01); *H01F 41/0246* (2013.01); *B22F 2998/10* (2013.01); *H01F 3/08* (2013.01); *H01F 27/255* (2013.01)

(56) References Cited

U.S. PATENT DOCUMENTS

2010/0323206 A1* 12/2010 Soma ..... H01F 1/24 428/446
2011/0024671 A1* 2/2011 Otsuki ..... B22F 1/02 252/62.54
2011/0068506 A1 3/2011 Kusawake et al.
2011/0227690 A1* 9/2011 Watanabe ..... C22C 38/00 336/221
2011/0285486 A1* 11/2011 Maeda ..... B22F 1/0062 335/297
2013/0015939 A1* 1/2013 Inagaki ..... B22F 1/02 336/233
2014/0104023 A1 4/2014 Yang et al.
2014/0125440 A1* 5/2014 Ueno ..... H01F 37/00 336/65
2014/0286814 A1* 9/2014 Kotani ..... C22C 38/00 419/30
2015/0352965 A1* 12/2015 Inaba ..... H01F 37/00 363/131

FOREIGN PATENT DOCUMENTS

JP 2001-11563 A 1/2001
JP 2002-141213 A 5/2002
JP 2005-50918 A 2/2005
JP 2008-109080 A 5/2008
JP 2009-295613 A 12/2009
JP 2009-296015 A 12/2009
JP 2010-1561 A 1/2010
JP 2011-21 6745 A 10/2011
JP 2013-546162 A 12/2013
JP 2015-103719 A 6/2015

* cited by examiner

SOFT MAGNETIC MEMBER, REACTOR, POWDER FOR DUST CORE, AND METHOD OF PRODUCING DUST CORE

INCORPORATION BY REFERENCE

The disclosure of Japanese Patent Application No. 2014-122429 filed on Jun. 13, 2014 including the specification, drawings and abstract is incorporated herein by reference in its entirety.

BACKGROUND OF THE INVENTION

1. Field of the Invention

The present invention relates to a soft magnetic member having superior magnetic characteristics, a reactor using the soft magnetic member, a powder for a dust core, and a method of producing a dust core.

2. Description of Related Art

In a hybrid vehicle, an electric vehicle, a solar power generation device, or the like, a reactor is used, and this reactor adopts a structure in which a coil is wound around a ring-shaped core which is a soft magnetic member. During use of the reactor, a wide range of currents flow through the coil. Therefore, at least 40 kA/m of magnetic field is applied to the core. In such an environment, it is necessary to stably secure the inductance of the reactor.

In consideration of the above-described points, for example, a reactor 9 is disclosed in which, as shown in FIG. 9A, a ring-shaped core 91 is divided into core portions 92A, 92B, a gap 93 is provided between the divided core portions 92A, 92B, and coils 95A, 95B are wound around the core 91 including this gap 93 (for example, refer to Japanese Patent Application Publication No. 2009-296015 (JP 2009-296015 A)).

According to the reactor 9, the gap 93 is provided between the divided core portions 92A, 92B; as a result, even when a wide range of currents flow through the coil 95 of the reactor 9, the inductance can be stably secured in this wide range of currents.

However, a soft magnetic member is used in a choke coil, an inductor, or the like. As such a soft magnetic member, a dust core is disclosed in which, when an initial magnetic permeability is represented by $\mu_0$ and a magnetic permeability in an applied magnetic field of 24 kA/m is represented by a relationship of $\mu/\mu_0 \geq 0.5$ is satisfied between $\mu_0$ and $\mu$ (for example, refer to Japanese Patent Application Publication No. 2002-141213 (JP 2002-141213 A)). According to this dust core, even if a high magnetic field is applied to the dust core, a decrease in the magnetic permeability of the dust core can be suppressed.

However, for example, in the technique disclosed in JP 2009-296015 A, the gap is formed between the divided core portions. Therefore, as shown in FIG. 9B, a magnetic flux T is leaked in the gap 93 formed between the divided core portions 92A, 92B. In particular, in a reactor of a hybrid vehicle or the like through which a high current flows, a high magnetic field of about 40 kA/m is applied to a core. Therefore, in order to maintain the inductance of the reactor (that is, the core) at the applied magnetic field, it is necessary to further increase the above-described gap. As a result, the leakage of the magnetic flux T from the gap is increased, and this leaked magnetic flux intersects with the coil, which causes eddy-current loss in the core.

The problem which is described above using the reactor is an example. In equipment or an apparatus in which a magnetic field in a range from a low magnetic field to a high magnetic field (40 kA/m) is applied to a soft magnetic member, it is difficult to maintain the inductance, and typically a structural measure is taken.

Even if a soft magnetic member having the characteristics disclosed in JP 2002-141213 A is used, as clearly seen from an experiment of the present inventors described below, the application of a high magnetic field of about 40 kA/m is not considered. Therefore, even if such a material is used, a significant decrease in inductance is assumed in a high magnetic field (about 40 kA/m).

SUMMARY OF THE INVENTION

The invention provides a soft magnetic member, a reactor, a powder for a dust core, and a method of producing a dust core, in which a decrease in inductance can be suppressed even if an applied magnetic field is high (about 40 kA/m).

As a result of a thorough study, the present inventors thought that, in order to suppress a decrease in inductance in a high magnetic field, it is important to secure a predetermined amount of magnetic flux density and to adjust a differential relative permeability to be high even in a high magnetic field. Therefore, the present inventors have focused on a ratio of a differential relative permeability in a specific low magnetic field to a differential relative permeability in a specific high magnetic field.

According to a first aspect of the invention, there is provided a soft magnetic member, in which when a differential relative permeability in an applied magnetic field of 100 A/m is represented by a first differential relative permeability $\mu'L$, and when a differential relative permeability in an applied magnetic field of 40 kA/m is represented by a second differential relative permeability $\mu'H$, a ratio of the first differential relative permeability $\mu'L$ to the second differential relative permeability $\mu'H$ satisfies a relationship of $\mu'L/\mu'H \leq 10$, and a magnetic flux density in an applied magnetic field of 60 kA/m is 1.15 T or higher.

In the soft magnetic member according to the aspect of the invention, the ratio of the first differential relative permeability $\mu'L$ to the second differential relative permeability $\mu'H$ satisfies a relationship of $\mu'L/\mu'H \leq 10$. As a result, the gradient of the B-H curve of the soft magnetic member can be secured to be large even in a high magnetic field, and the inductance of the soft magnetic member in a magnetic field of 40 kA/m can be maintained.

Here, when $\mu'L/\mu'H > 10$, a difference in differential relative permeability between a low magnetic field and a high magnetic field is increased. As a result, when a magnetic field is applied to a high magnetic field region, a decrease in inductance is increased. For example, when a core is divided into portions in a reactor, it is necessary that a gap between the divided portions be increased in order to maintain the inductance of the reactor. As a result, a leakage of a magnetic flux from the gap is increased, and this leaked magnetic flux intersects with the coil, which causes eddy-current loss in the core. It is preferable that $\mu'L/\mu'H$ is low, and the lower limit thereof is 1. When $\mu'L/\mu'H < 1$, it is difficult to produce a soft magnetic member.

In addition, a magnetic flux density of 1.15 T or higher is secured in an applied magnetic field of 60 kA/m, and thus the inductance value can be maintained in a range from a low magnetic field to a high magnetic field. That is, when the magnetic flux density in an applied magnetic field of 60 kA/m is lower than 1.15 T, a decrease in inductance in a range from a low magnetic field to a high magnetic field is a concern. Therefore, this soft magnetic member is not sufficient for use in equipment such as a reactor. The upper limit of the magnetic flux density in an applied magnetic field of 60 kA/m is preferably 2.1 T. Since the saturated magnetic flux density of pure iron is about 2.2 T, it is difficult to produce a soft magnetic member having a magnetic flux density of more than 2.2 T.

Here, "differential relative permeability" described herein is obtained by dividing a gradient of a tangent to a curve (B-H curve) between a magnetic field H and a magnetic flux density B by a space permeability, the curve being obtained by continuously applying a magnetic field. For example, a differential relative permeability in a magnetic field of 40 kA/m (second differential relative permeability μ'H) is obtained by dividing a gradient of a tangent to a B-H curve in a magnetic field of 40 kA/m by a space permeability.

In the soft magnetic member according to the aspect of the invention, the soft magnetic member may be a dust core formed from a powder for the dust core; in the powder for the dust core, surfaces of soft magnetic particles may be coated with an insulating film; and the insulating film may have a Vickers hardness, which is 2.0 times or higher than that of the soft magnetic particles, and may have a thickness of 150 nm to 2 μm.

As clearly seen from an experiment of the present inventors described below, when a compact as a dust core is formed, a material constituting the insulating film is not likely to be unevenly distributed in a boundary (triple point) between three particles of a powder for a dust core by adjusting the Vickers hardness and the thickness of the insulating film to be in the above-described ranges. As a result, after the formation of the compact, the distance between soft magnetic particles is secured, and a non-magnetic material as a material of the insulating film is maintained between the soft magnetic particles.

In a dust core obtained by sintering the compact obtained as described above, the magnetic flux density during the application of a low magnetic field to the soft magnetic member can be decreased without decreasing the magnetic flux density in an applied magnetic field of 60 kA/m. That is, even when a magnetic field in a range from a low magnetic field (100 A/m) to a high magnetic field (40 kA/m) is applied to the dust core, a decrease in differential relative permeability in a high magnetic field can be suppressed. As a result, the inductance of the dust core in the above-described applied magnetic field range can be maintained.

Here, when the Vickers hardness of the insulating film is lower than two times that of the soft magnetic particles, a material constituting the insulating film is likely to be unevenly distributed in a boundary (triple point) between three particles of a powder for a dust core during the formation of the powder. When the Vickers hardness of the insulating film is higher than 20 times that of the soft magnetic particles, the insulating film is too hard to compression-form a powder for a dust core.

When the thickness of the insulating film is less than 150 nm, the distance between the soft magnetic particles cannot be sufficiently secured, which may increase μ'L/μ'H. On the other hand, when the thickness of the insulating film exceeds 2 μm, an occupancy of a non-magnetic component (insulating film) increases, and thus it is difficult to satisfy a relationship in which the magnetic flux density in an applied magnetic field of 60 kA/m is 1.15 T or higher.

Further, in the above-described aspect, the soft magnetic particles may be formed of an iron-aluminum-silicon alloy, and the insulating film may contain aluminum oxide as a major component. By selecting such a material, the above-described relationship of μ'L/μ'H≤10 is satisfied, and the condition where the magnetic flux density in an applied magnetic field of 60 kA/m is 1.15 T or higher is likely to be satisfied.

In particular, when aluminum of the soft magnetic particles formed of an iron-aluminum-silicon alloy is preferentially oxidized by oxidizing gas having a predetermined gas ratio, the above-described hardness relationship and the above-described thickness range can be easily satisfied.

According to a second aspect of the invention, there is provided a reactor. The reactor includes: a core formed of the above-described dust core; and a coil that is wound around the core. In such a reactor, even when a current in a range from a low current to a high current flows through the coil, the inductance is maintained. Therefore, the core is not necessarily divided, or even if the core is divided into portions, a gap between the divided portions can be reduced. As a result, eddy-current loss of the coil due to a leaked magnetic flux can be removed or decreased.

Further, according to a third aspect of the invention, there is provided a powder for a dust core which is suitable for the above-described dust core. In the powder for the dust core according to the third aspect of the invention, surfaces of soft magnetic particles may be coated with an insulating film, and the insulating film may have a Vickers hardness, which is 2.0 times or higher than that of the soft magnetic particles, and may have a thickness of 150 nm to 2 μm.

By using the powder for a dust core, the relationship of μ'L/μ'H≤10 can be satisfied, and a powder for a dust core having an magnetic flux density of 1.15 T or higher in an applied magnetic field of 60 kA/m can be easily produced.

In the above-described aspect, the soft magnetic particles may be formed of an iron-aluminum-silicon alloy, and the insulating film may contain aluminum oxide as a major component. In particular, when aluminum of the soft magnetic particles formed of an iron-aluminum-silicon alloy is preferentially oxidized by oxidizing gas having a predetermined gas ratio, the above-described hardness relationship and the above-described thickness range can be easily satisfied.

According to a fourth aspect of the invention, there is provided a method of producing a dust core including: forming a green compact from the powder for the dust core according to the above-described aspect of the invention, and; sintering the green compact. As a result, a dust core having the above-described characteristics can be obtained.

According to the above-described aspects of the invention, even when the applied magnetic field is high (about 40 kA/m), a decrease in inductance can be suppressed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIGS. 1A to 1C are schematic diagrams showing a method of producing a soft magnetic member (dust core) according to an embodiment of the invention, in which FIG. 1A is a diagram showing soft magnetic particles, FIG. 1B is a diagram showing particles constituting a powder for a dust core, and FIG. 1C is a diagram showing a particle state in a compact;

FIGS. 2A to 2D are schematic diagrams showing a method of producing a soft magnetic member (dust core) of the related art, in which FIG. 2A is a diagram showing soft magnetic particles, FIG. 2B is a diagram showing particles constituting a powder for a dust core, FIG. 2C is a diagram showing a particle state in a compact, and FIG. 2D is an enlarged image showing a dust core produced using the method of the related art;

DETAILED DESCRIPTION OF EMBODIMENTS

Hereinafter, an embodiment of a powder for a dust core according to the invention and a soft magnetic member formed from the powder will be described with reference to the drawings.

Figure 1A:
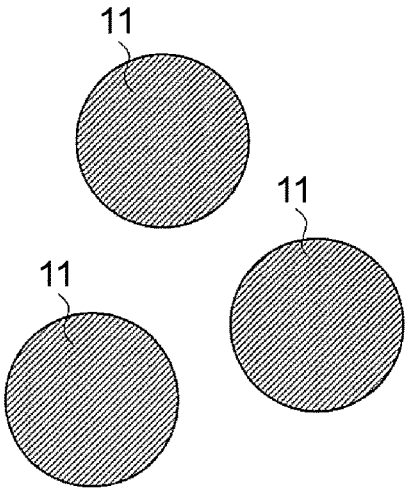
Figure 1B:
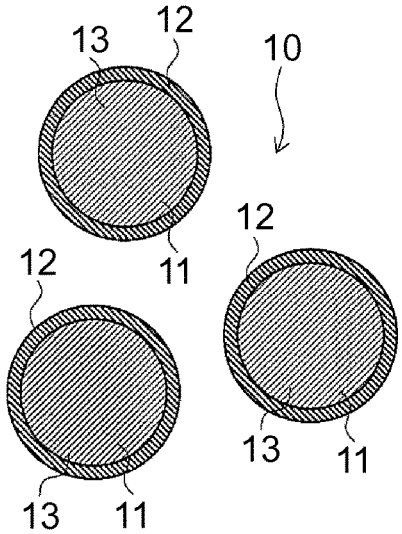
Figure 1C:
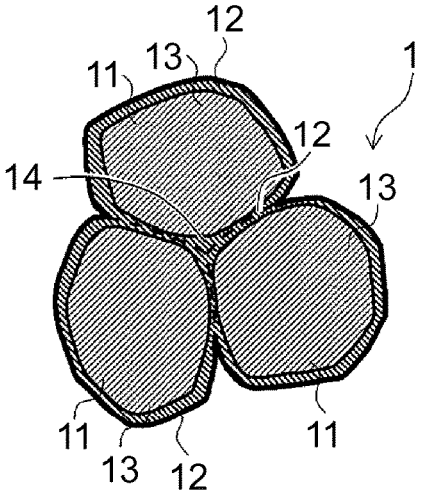

FIGS. 1A to 1C are schematic diagrams showing a method of producing a soft magnetic member (dust core) according to an embodiment of the invention, in which FIG. 1A is a diagram showing soft magnetic particles, FIG. 1B is a diagram showing particles constituting a powder for a dust core, and FIG. 1C is a diagram showing a particle state in a compact;

As shown in FIG. 1B, the powder 10 for a dust core according to the embodiment is an aggregate of particles 13 for a dust core. The particles 13 for a dust core include: soft magnetic particles 11 formed of a soft magnetic material; and an insulating film 12 formed of a non-magnetic material, in which surfaces of the soft magnetic particles 11 are coated with the insulating film 12, and the insulating film has a hardness, which is 2 times or higher than that of the soft magnetic particles 11, and has a thickness of 150 nm to 2 μm.

The average particle size of particles (on which the insulating film is formed) constituting the powder 10 for a dust core is preferably 5 μm to 500 μm and more preferably 20 μm to 450 μm. By using the soft magnetic powder having an average particle size in the above-described range, a dust core having superior insulating properties can be obtained. When the average particle size is less than 20 μm, a ratio of an insulating material constituting the insulating film is increased, which decreases the saturated magnetic flux density. On the other hand, when the average particle size is more than 450 μm, a ratio of an insulating material constituting the insulating film is decreased, and it is difficult to obtain desired magnetic characteristics and desired insulating properties (specific resistance). When the average particle size is more than 500 μm, it is difficult to obtain insulating properties, and the eddy current of the particles (powder) is increased, and the loss is increased.

A method of producing the powder 10 for a dust core will be described below. First, as shown in FIG. 1A, as the soft magnetic material constituting the soft magnetic particles (base particles) 11, for example, iron, cobalt, or nickel is prepared. More preferably, an iron-based material may be used, and examples thereof include iron (pure iron), an iron-silicon alloy, an iron-nitrogen alloy, an iron-nickel alloy, an iron-carbon alloy, an iron-boron alloy, an iron-cobalt alloy, an iron-phosphorus alloy, an iron-nickel-cobalt alloy, and an iron-aluminum-silicon alloy.

Examples of the soft magnetic powder formed of the soft magnetic particles 11 include water-atomized powder, gas-atomized powder, and pulverized powder. From the viewpoint of suppressing a destruction of an insulating layer during press forming, it is more preferable to select a powder having a small amount of convexo-concave portions on particle surfaces.

When the above-described metals are selected as the soft magnetic material constituting the soft magnetic particles 11, for example, iron oxide ($Fe_3O_4$, $Fe_2O_3$), iron nitride, silicon oxide ($SiO_2$), or silicon nitride ($Si_3O_4$) can be used as the material of the insulating film 12 under the condition that the above-described thickness range and the above-described hardness relationship of the film are satisfied. As another conditions, it is necessary that the formed dust core satisfy a relationship of $\mu'L/\mu'H \leq 10$ described below and satisfy a magnetic flux density of 1.15 T or higher in an applied magnetic field of 60 kA/m.

In addition, the insulating film 12 can be formed on the soft magnetic particles 11 by oxidizing the surfaces of the soft magnetic particles 11 shown in FIG. 1A. As another method, the above-described material constituting the insulating film may be attached on the surfaces of the soft magnetic particles 11 shown in FIG. 1A using PVD, CVD, or the like.

In the embodiment, an iron-aluminum-silicon alloy is used as the soft magnetic material constituting the soft magnetic particles 11. The soft magnetic particles 11 formed of the metal alloy are oxidized by being heated using a mixed oxidizing gas containing nitrogen gas and oxygen gas at a predetermined ratio, the gases being supplied from industrial gas cylinders. At this time, aluminum is dispersed and compressed on the surfaces of the soft magnetic particles 11, and aluminum is preferentially oxidized.

As a result, a film containing aluminum oxide having a high purity as a major component (containing aluminum oxide and unavoidable impurities) can be formed. Aluminum oxide has higher hardness and insulating properties than those of other materials, is superior in heat resistance, and is highly stable to a chemical solution such as a coolant. As a result, the insulating film 12 formed of aluminum oxide, which has a hardness two times or higher than that of the soft magnetic particles 11 and has a thickness of 150 nm to 2 μm, can be easily obtained.

Here, in the iron-aluminum-silicon alloy, it is preferable that the Si content is 1 mass % to 7 mass %, the Al content is 1 mass % to 6 mass %, the total content of Si and Al is 1 mass % to 12 mass %, and the balance includes iron and unavoidable impurities.

Here, when the contents of Si and Al are lower than the above-described ranges, it is difficult to produce aluminum oxide, other oxides are produced, and thus magnetic loss increases. In addition, when the Si content exceeds the above-described range, the plastic deformation resistance of the powder for a dust core increases, and the formability into a dust core deteriorates. Therefore, the saturated magnetic flux density decreases. In addition, when the total content of Si and Al exceeds the above-described range, or when the Al content exceeds the above-described range, a ratio of iron in the soft magnetic particles decreases, and the saturated magnetic flux density decreases.

As shown in FIG. 1C, the powder for a dust core is compression-formed into a green compact, and this green compact is annealed by a heat treatment. As a result, a dust core 1 can be obtained. At this time, the insulating film 12, which has a hardness two times or higher than that of the soft magnetic particles 11 and has a thickness of 150 nm to 2 μm, is provided. Therefore, the material (non-magnetic material) constituting the insulating film 12 is not likely to be distributed in a boundary 14 (triple point) between three particles 13, 13, 13 (base material) for a dust core. As a result, after the formation of the compact, the distance between the soft magnetic particles 11, 11 is secured, and the non-magnetic material as the material of the insulating film 12 is maintained between the soft magnetic particles.

Figure 2A:
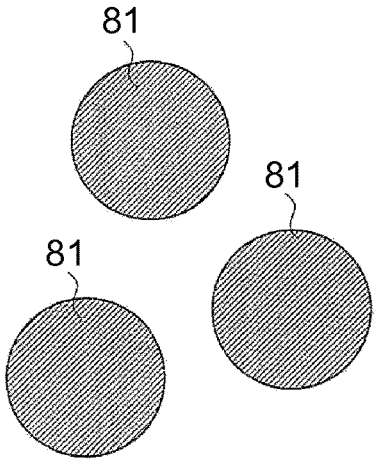
FIG. 2A RELATED ART
Figure 2B:
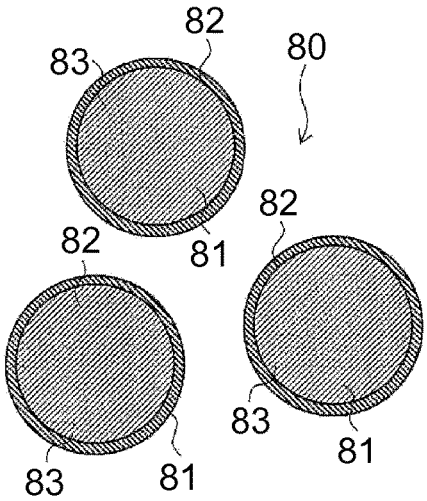
FIG. 2B RELATED ART

In the related art, as shown in FIG. 2B, a powder 80 for a dust core formed of particles 83 for a dust core is used, in which surfaces of soft magnetic particles 81 are coated with a soft insulating film 82 formed of a silicone resin or the like. When a magnetic field in a range from a low magnetic field to a high magnetic field is applied to a dust core 8 of FIG. 2C produced using the powder 80 for a dust core, in a high magnetic field (exceeding 40 kA/m), the magnetic flux density approaches the saturated magnetic flux density, and the differential relative permeability decreases.

The inductance L of the dust core (reactor) is represented by $L=n\cdot S\cdot\mu'$ (wherein n: the winding number of the coil, S: the cross-sectional area of a portion of the dust core around which the core is wound, μ': the differential relative permeability). In order to maintain characteristics of the inductance L in a high magnetic field, it is important to suppress a decrease in differential relative permeability in a high magnetic field.

Figure 3A:
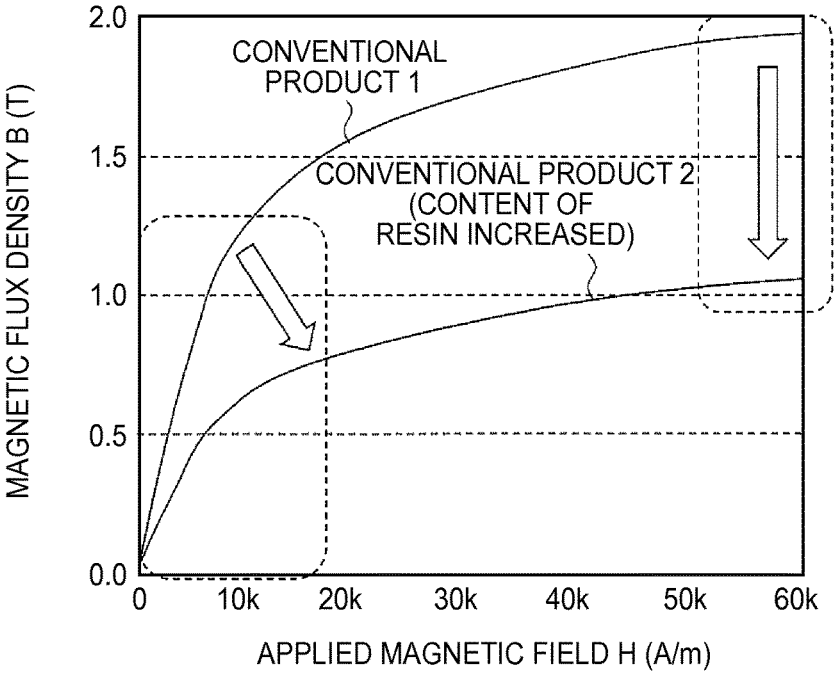
FIG. 3A is a diagram showing a relationship between an applied magnetic field and a magnetic flux density in each of Conventional Product 1 and Conventional Product 2 in which the amount of a resin is more than that of Conventional Product 1.

Here, the magnetic field H applied to the dust core is represented by $H=n\cdot I/L$ (wherein n: the winding number of the coil, I: the current flowing through the coil, L: the magnetic path length of the dust core), in which the current I flowing through the coil is proportional to the applied magnetic field H. Accordingly, in the dust core 8 (Conventional Product 1) shown in FIG. 3A, in order to suppress a decrease in differential relative permeability in a high magnetic field, a decrease in differential relative permeability in a low magnetic field is effective.

Therefore, in Conventional Product 1, when the thickness of the insulating film 82 shown in FIG. 2B is increased (when a ratio of a resin is increased), the differential relative permeability in a low magnetic field can be decreased by increasing the content of the resin as a non-magnetic component. However, in Conventional Product 2 of FIG. 3A, the saturated magnetic flux density in a high magnetic field is decreased.

Figure 2C:
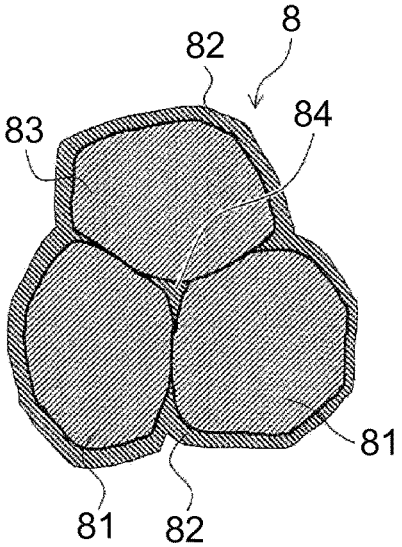
FIG. 2C RELATED ART
Figure 2D:
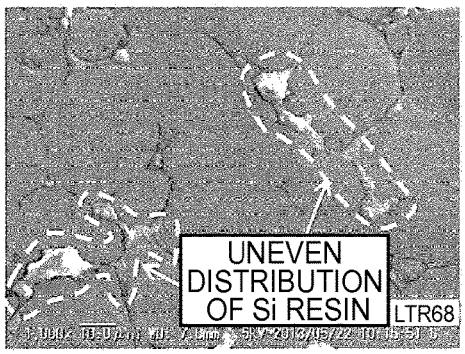
FIG. 2D RELATED ART

One of the reasons is presumed to be as follows: as shown in FIG. 2C, a material (non-magnetic material) constituting the insulating film 82 is unevenly distributed in the boundary (triple point) 84 between three particles 83, 83, 83 for a dust core when a compact is formed using the powder 80 for a dust core. As shown in FIG. 2D, the uneven distribution of the resin in the triple point was verified from an experiment of the present inventors.

Figure 3B:
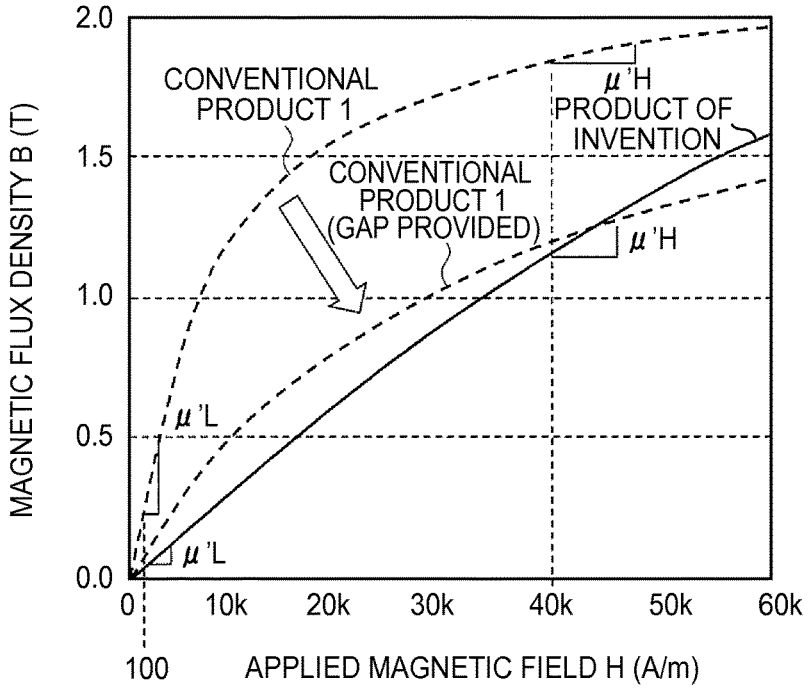
FIG. 3B is a diagram showing a relationship between an applied magnetic field and a magnetic flux density in each of Conventional Product 1 and a product of the invention.
Figure 9A:
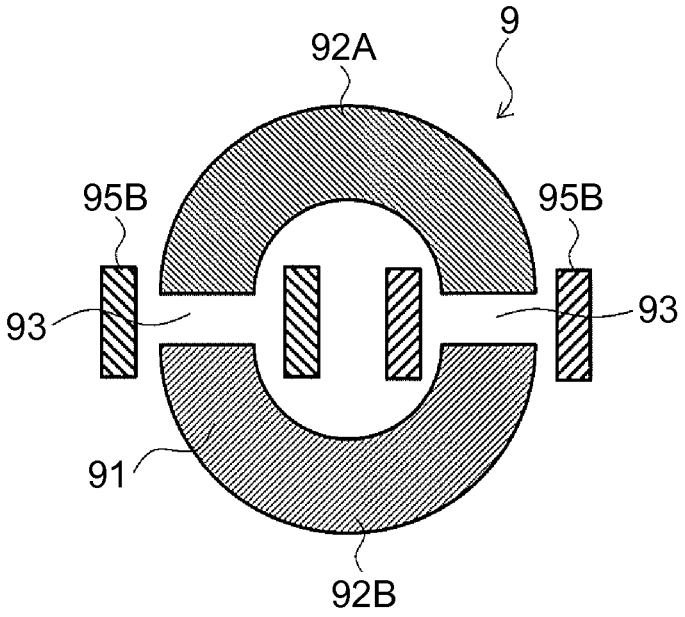
FIG. 9A is a schematic diagram showing a reactor of the related art.
Figure 9B:
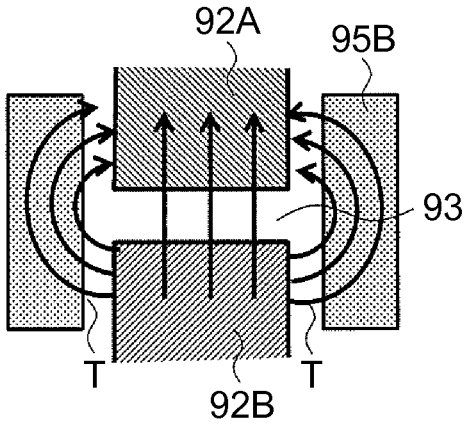
FIG. 9B is an enlarged view showing major components of the reactor in FIG. 9A.

From this point of view, it can be considered that, by providing a gap in Conventional Product 1 (core) as shown in FIG. 9A, the magnetic flux density in a low magnetic field can be decreased, and a decrease in differential relative permeability in a high magnetic field can be decreased as shown in Conventional Product 1 (gap provided) of FIG. 3B. However, when such a gap is provided, a leakage of a magnetic flux T from the gap is increased as shown in FIG. 9B, this leaked magnetic flux intersects with the coil, which causes eddy-current loss in the core.

In the embodiment, the hardness and the thickness of the insulating film 12 shown in FIG. 1B are adjusted to be in the above-described ranges. As a result, when a compact as the dust core 1 is formed, the material (non-magnetic material) constituting the insulating film 12 is not likely to be unevenly distributed in the boundary (triple point) 14 between three particles of the powder 10 for a dust core. As a result, after the formation of the compact, the distance between the soft magnetic particles 11, 11 is secured, and the non-magnetic material as the material of the insulating film 12 is maintained between the soft magnetic particles.

In the dust core 1 obtained by sintering the compact obtained as described above, when a differential relative permeability in an applied magnetic field of 100 A/m is represented by a first differential relative permeability μ'L, and when a differential relative permeability in an applied magnetic field of 40 kA/m is represented by a second differential relative permeability μ'H, a ratio of the first differential relative permeability μ'L to the second differential relative permeability μ'H satisfies a relationship of $\mu'L/\mu'H\leq 10$, and a magnetic flux density in an applied magnetic field of 60 kA/m is 1.15 T or higher.

As a result, as shown in a product of the invention of FIG. 3B, even when a magnetic field in a range from a low magnetic field (100 A/m) to a high magnetic field (40 kA/m) is applied to the dust core, a decrease in differential relative permeability in a high magnetic field can be suppressed. As a result, the inductance of the dust core (reactor) in the above-described applied magnetic field range can be maintained.

In the embodiment, as shown in FIG. 9A, unlike the techniques of the related art, it is not necessary to provide a large gap between divided core portions. Therefore, a leakage of the magnetic flux in a reactor can be suppressed.

Hereinafter, the invention will be described using Examples.

Example 1

Preparation of Powder for Dust Core

As a soft magnetic powder constituting soft magnetic particles, a water-atomized power (maximum particle size: 75 μm; measured using a measured sieve defined according to JIS-Z8801) formed of an iron-silicon-aluminum alloy (Fe-5Si-4Al) containing 5 mass % of Si and 4 mass % of Al in addition to Fe was prepared.

Next, the water-atomized powder was heated at 900° C. for 300 minutes in an atmosphere of a mixed oxidizing gas containing 20 vol % of oxygen gas and 80 vol % of nitrogen gas, the gases being supplied from industrial gas cylinders. As a result, surfaces of the soft magnetic particles were coated with a film formed of aluminum oxide ($Al_2O_3$) having a thickness of 460 nm as an insulating film. The formation of aluminum oxide was measured using XRD analysis, and the thickness was measured using Auger spectroscopy analysis (AES).

<Preparation of Ring Test Piece (Dust Core)>

The powder for a dust core is put into a die, and a ring-shaped green compact having an outer diameter of 39 mm, an inner diameter of 30 mm, and a thickness of 5 mm was prepared using a die lubrication warm forming method under conditions of a forming temperature of 130° C. and a forming pressure of 16 t/cm$^2$. The formed green compact was heat-treated (sintered) in a nitrogen atmosphere at 750° C. for 30 minutes. As a result, a ring test piece (dust core) was prepared.

Comparative Example 1

A ring test piece (dust core) was prepared using the same method as that of Example 1. Comparative Example 1 was different from Example 1, in that an iron-silicon alloy (Fe-3Si) powder containing 3 mass % of Si in addition to Fe was used as a soft magnetic powder constituting the soft magnetic particles, 0.5 mass % of silicone resin was added to the powder, and soft magnetic particles were coated with this film at a film-forming temperature of 130° C. for a film-forming time of 130 minutes to prepare a powder for a dust core.

<Evaluation of Ring Test Piece>

Figure 4:
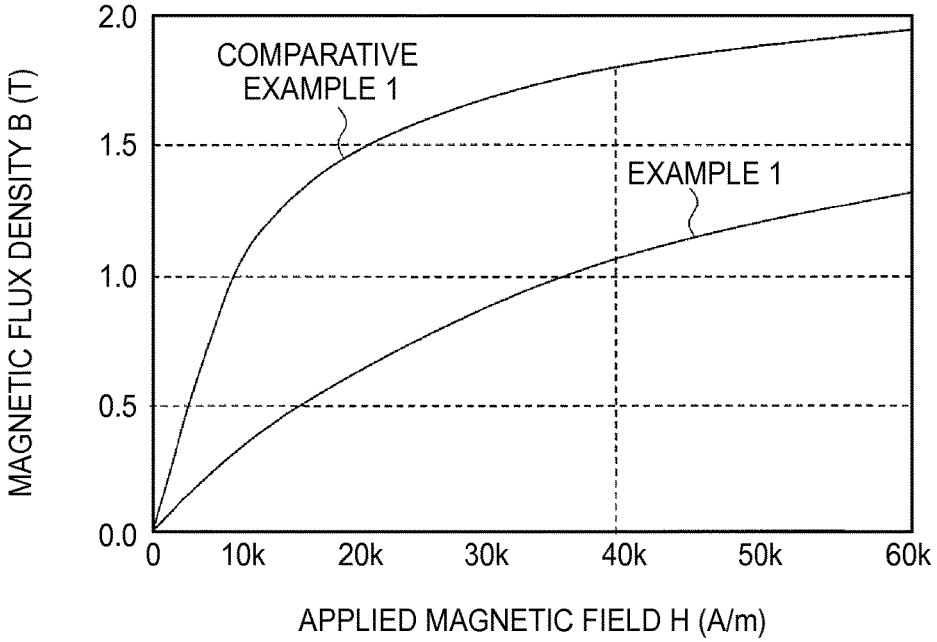
FIG. 4 is a B-H curve diagram showing ring test pieces of Example 1 and Comparative Example 1.

Using an Autograph, coils were wound around each of the ring test pieces prepared in Example 1 and Comparative Example 1 under conditions of a winding number of 450 turns on an excitation side and 90 turns on a detection side. Next, by causing a current to flow through the coil, a magnetic field was applied so as to linearly increase from 0 kA/m to 60 kA/m. At this time, the magnetic flux density was measured using a DC magnetic flux meter. The results are shown in FIG. 4. FIG. 4 is a B-H curve diagram of the ring test pieces of Example 1 and Comparative Example 1.

From the obtained graph (B-H curve diagram) showing the applied magnetic field and the magnetic flux density, the first differential relative permeability μ'L in an applied magnetic field of 100 A/m, the second differential relative permeability μ'H in an applied magnetic field of 40 kA/m, and μ'L/μ'H were calculated. The results are shown in Table 1. In addition, regarding each of the ring test pieces of Example 1 and Comparative Example 1, the magnetic flux density in an applied magnetic field of 60 kA/m was measured. The results are shown in Table 1.

Specifically, the first differential relative permeability μ'L is a value calculated by calculating a gradient (ΔB/ΔH) of a line connecting two points around an applied magnetic field of 100 A/m in the B-H curve of FIG. 4 and dividing this gradient by a space permeability. Likewise, the second differential relative permeability μ'H is a value calculated by calculating a gradient (ΔB/ΔH) of a line connecting two points around an applied magnetic field of 40 A/m in the B-H curve of FIG. 4 and dividing this gradient by a space permeability. μ'L/μ'H is a value of the first differential relative permeability μ'L/the second differential relative permeability μ'H.

TABLE 1

| | Example 1 | Comparative Example 1 |
|---|---|---|
| First Differential Relative Permeability μ'L | 45 | 151 |
| Second Differential Relative Permeability μ'H | 11.1 | 6.5 |
| μ'L/μ'H | 4 | 23 |
| Magnetic Flux Density (T) in Magnetic Field of 60 kA/m | 1.33 | 1.95 |

[Result 1]

As shown in Table 1, in the ring test piece (dust core) of Example 1, the ratio μ'L/μ'H of the first differential relative permeability μ'L to the second differential relative permeability μ'H was about ⅙ of that of Comparative Example and was 10 or lower (specifically, 4). That is, it can be said that, in the dust core of Example 1, a decrease in differential relative permeability in a high magnetic field was suppressed as compared to the dust core of Comparative Example 1.

The reason is presumed to be as follows. In the dust core of Example 1, the powder for a dust core was used in which the soft magnetic particles were coated with the insulating film formed of aluminum oxide $Al_2O_3$. Therefore, during compression forming, the insulating film is less likely to flow as compared to that of Comparative Example 1 in which a silicone resin was used. As a result, in the dust core of Example 1, as compared to that of Comparative Example 1, the insulating film was secured between the soft magnetic particles. Therefore, it is considered that, even when the applied magnetic field was high, a decrease in differential relative permeability was suppressed.

In addition, in the dust core of Example 1, the magnetic flux density in an applied magnetic field of 60 kA/m was sufficiently high at 1.15 T which was equivalent to that of Comparative Example 1, and the first differential relative permeability μ'L was suppressed to be low. As a result, it is considered that the second differential relative permeability 11'H was able to be maintained to be high, and the ratio μ'L/μ'H of the first differential relative permeability μ'L to the second differential relative permeability μ'H was able to satisfy μ'L/μ'H≤10.

<Measurement of Inductance>

Figure 5:
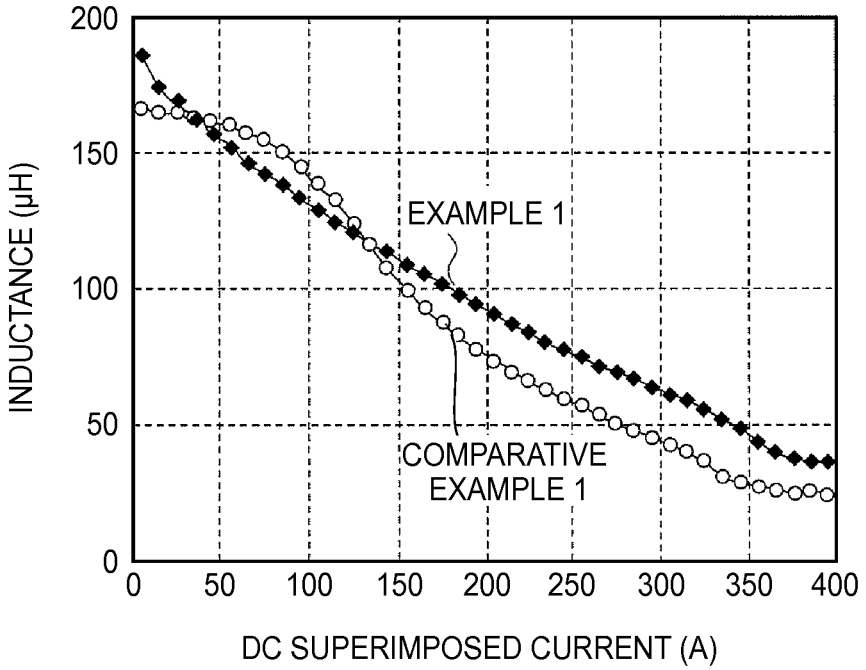
FIG. 5 is a diagram showing a relationship between an inductance and a DC superimposed current in each of reactors of Example 1 and Comparative Example 1.

Further, a core of a reactor was prepared from each of the dust cores corresponding to Example 1 and Comparative Example 1. Using this core, a reactor shown in FIG. 9A was prepared. When a DC superimposed current was applied to the coil, the inductance of the reactor was measured. The results are shown in FIG. 5. At this time, the gap width of the core (dust core), the measured inductance, the magnetic loss of the reactor, and the eddy-current loss of the coil were measured. The results are shown in Table 2. The current values in parentheses shown in Table 2 are current values flowing through the coil during the measurement.

TABLE 2

| | Example 1 | Comparative Example 1 |
|---|---|---|
| Inductance L (at 10 A) | 174 μH | 165 μH |
| Inductance L (at 100 A) | 128 μH | 138 μH |
| Inductance L (at 200 A) | 90 μH | 73 μH |
| Gap Length | 1.8 mm | 2.4 mm |
| Magnetic Loss (at 50 A) | 102 W | 128 W |
| Eddy-Current Loss of Coil | 24 W | 40 W |

[Result 2]

As shown in FIG. 5 and Table 2, in the reactor of Example 1, although the gap length was shorter than that of Comparative Example 1 by 0.6 mm (decrease by 25%), the inductance value was higher than that of Comparative Example 1 even in a high current region of 150 A or higher (that is, in a high magnetic field). That is, as shown in Table 1, it can be said that, in the dust core of Example 1, a decrease in differential relative permeability in a high magnetic field was suppressed as compared to the dust core of Comparative Example 1.

In addition, as shown in Table 2, in the reactor of Example 1, the gap length of the core was shorter than that of Comparative Example 1. As a result, it is considered that the leakage of the magnetic flux between the core portions shown in FIG. 9B was decreased, and the magnetic loss and the eddy-current loss of the coil were decreased.

Examples 2 to 7

A ring test piece (dust core) was prepared using the same method as that of Example 1. Examples 3 to 5 were different from Example 1, in that, as shown in Table 3, a water-atomized power formed of an iron-silicon-aluminum alloy (Fe-2Si-4Al) containing 2 mass % of Si and 4 mass % of Al in addition to Fe was used as a soft magnetic powder constituting soft magnetic particles (base particles).

In addition, Example 4 was further different from Example 1, in that the forming surface pressure was changed to 8 t/cm$^2$. Example 5 was further different from Example 1, in that the forming surface pressure was changed to 12 t/cm$^2$. Example 7 was further different from Example 1, in that the heating time in an oxidizing atmosphere was changed to 120 minutes. In Examples 2 and 6, the production conditions were the same as those of Example 1. Table 3 also shows the production conditions of Example 1 in order to clearly see the differences in production conditions between the ring test piece of Example 1 and the ring test pieces of Examples 2 to 7.

TABLE 3

| | Base Particles | Maximum Particle Size of Base Material (μm) | Oxidizing Conditions Temperature (° C.) | Oxidizing Conditions Time (min) | Forming Surface Pressure (t/cm$^2$) | Density (g/cm$^3$) |
|---|---|---|---|---|---|---|
| Example 1 | Fe—5Si—4Al | 75 | 900 | 300 | 16 | 6.20 |
| Example 2 | Fe—5Si—4Al | 75 | 900 | 300 | 16 | 6.21 |
| Example 3 | Fe—2Si—4Al | 75 | 900 | 300 | 16 | 6.79 |
| Example 4 | Fe—2Si—4Al | 75 | 900 | 300 | 8 | 6.21 |
| Example 5 | Fe—2Si—4Al | 75 | 900 | 300 | 12 | 6.57 |
| Example 6 | Fe—5Si—4Al | 75 | 900 | 300 | 16 | 6.19 |
| Example 7 | Fe—5Si—4Al | 75 | 900 | 120 | 16 | 6.20 |

Comparative Examples 2, 3

A ring test piece (dust core) was prepared using the same method as that of Example 1. Comparative Examples 2 and 3 were different from Example 1, in that as shown in Table 4, iron-silicon alloy (Fe-3Si) powders having maximum particle sizes of 45 μm and 180 μm, which contained 3 mass % of Si in addition to Fe, were used as a soft magnetic powder constituting the base particles, 0.5 mass % of silicon resin was added to the powders, and soft magnetic particles were coated with this film at a film-forming temperature of 170° C. for a film-forming time of 170 minutes to prepare powders for a dust core. Table 4 also shows the production conditions of Comparative Example 1 in order to clearly see the differences in production conditions between the dust core of Comparative Example 1 and the dust cores of Comparative Examples 2 and 3.

TABLE 4

| | Base Particles | Maximum Particle Size of Base Material (μm) | Coating Conditions Content of Resin (mass %) | Coating Conditions Film-Forming Temperature (° C.) | Coating Conditions Film-Forming Time (min) | Forming Surface Pressure (t/cm$^2$) | Density (g/cm$^3$) |
|---|---|---|---|---|---|---|---|
| Comparative Example 1 | Fe—3Si | 180 | 0.5 | 130 | 130 | 16 | 7.25 |
| Comparative Example 2 | Fe—3Si | 45 | 0.5 | 170 | 170 | 16 | 7.25 |
| Comparative Example 3 | Fe—3Si | 180 | 0.5 | 170 | 170 | 16 | 7.30 |

Comparative Examples 4, 5

In Comparative Example 4, as shown in Table 5, as a soft magnetic powder constituting the soft magnetic particles, an iron-silicon alloy (Fe-6.5Si) powder containing 6.5 mass % of Si in addition to Fe was prepared, the soft magnetic powder was kneaded with a polyphenylene sulfide (PPS) resin such that the content of the PPS resin was 65 vol %, and the kneaded material was injected into the same size and the same shape as those of Example 1. As a result, a ring test piece was prepared.

In Comparative Example 5, a ring test piece was prepared by injection molding using the same method as that of Comparative Example 4. Comparative Example 5 was different from Comparative Example 4, in that, as shown in Table 5, the soft magnetic powder was kneaded with a polyphenylene sulfide (PPS) resin such that the content of the PPS resin was 72 vol %.

Comparative Example 6

In Comparative Example 6, as shown in Table 5, as a soft magnetic powder constituting the soft magnetic particles, an iron-silicon alloy (Fe-6.5Si) powder containing 6.5 mass % of Si in addition to Fe was prepared, the soft magnetic powder was kneaded with an epoxy resin such that the content of the epoxy resin was 60 vol %, the kneaded material was put into a forming die having the same size and the same shape as those of Example 1, and the epoxy resin was cured. As a result, a ring test piece was prepared.

TABLE 5

| | Base Particles | Coating Conditions Resin | Content (vol %) | Density (g/cm$^3$) |
|---|---|---|---|---|
| Comparative Example 4 | Fe—6.5Si | PPS | 65 | 5.29 |
| Comparative Example 5 | Fe—6.5Si | PPS | 72 | 5.71 |
| Comparative Example 6 | Fe—6.5Si | Epoxy | 60 | 4.93 |

<Measurement of Density of Ring Test Piece>

Regarding each of the ring test pieces of Examples 1 to 7 and Comparative Examples 1 to 6, the weight was measured, and the density was measured from the volume during the formation. The results are shown in the respective items of Tables 3 to 5. In the ring test pieces of Comparative Examples 4 to 6, the content of the resin was high, and thus the density was lower than that of Examples 1 to 7 and Comparative Examples 1 to 3.

<Evaluation of Ring Test Piece>

Regarding each of the ring test pieces of Examples 2 to 7 and Comparative Examples 2 to 6, the magnetic flux density was measured by applying a magnetic current until 60 kA/m using the same method as that of Example 1. The first differential relative permeability μ'L in an applied magnetic field of 100 A/m, the second differential relative permeability μ'H in an applied magnetic field of 40 kA/m, and μ'L/μ'H were calculated. Further, μ'24 k/μ'L was also calculated by measuring a first differential relative permeability μ'24 k in an applied magnetic field of 24 kA/m. The results are shown in Table 6. The magnetic flux density shown in Table 6 refers to the value in an applied magnetic field of 60 kA/m.

Figure 6:
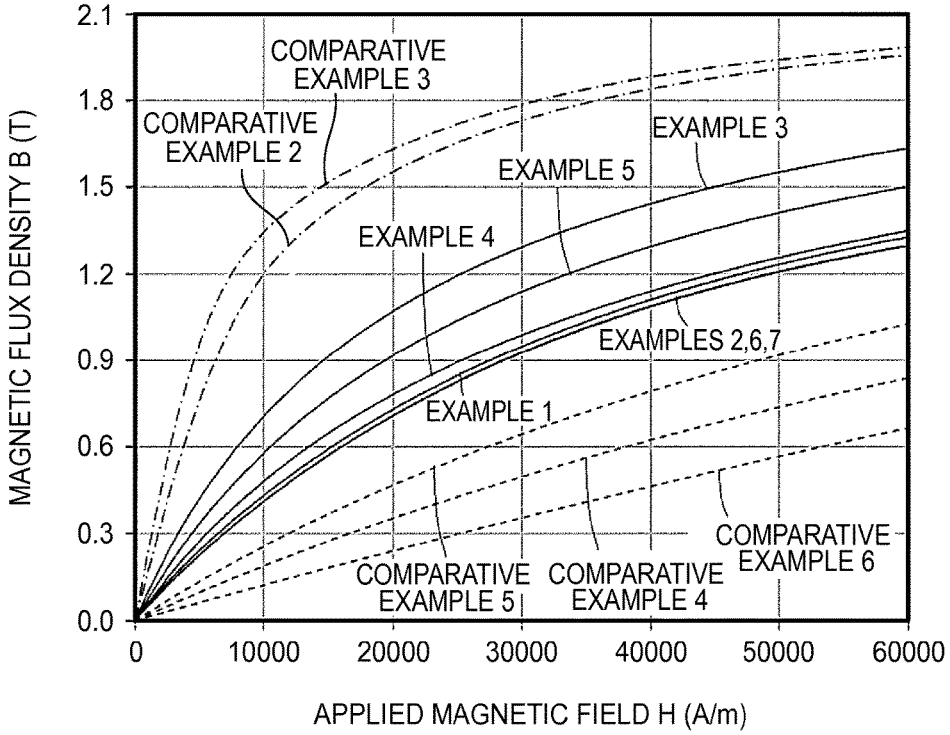
FIG. 6 is a B-H curve diagram showing ring test pieces of Examples 1 to 7 and Comparative Examples 2 to 6.
Figure 7:
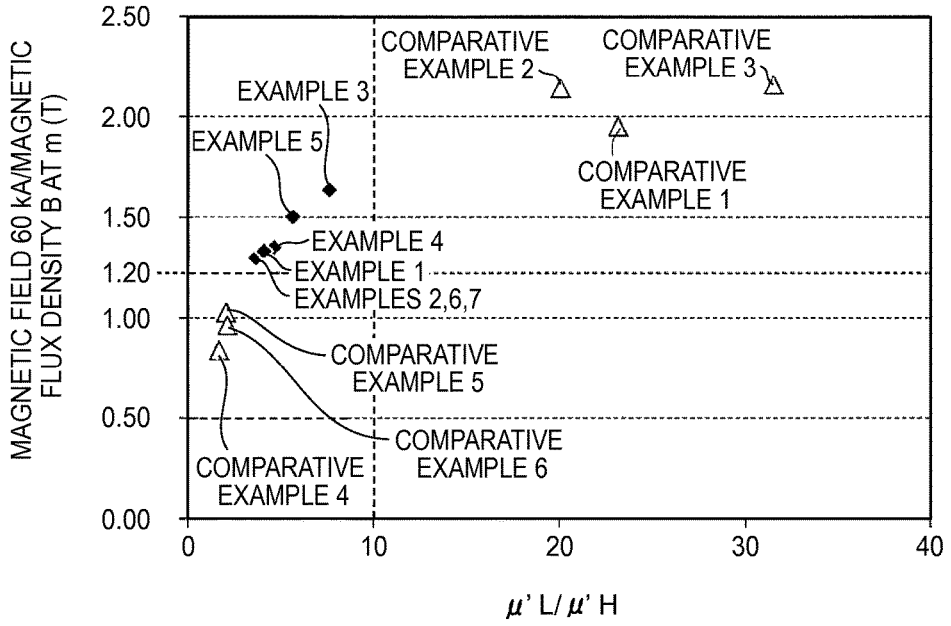
FIG. 7 is a diagram showing a relationship between μ'L/μ'H and a magnetic flux density B in an applied magnetic field of 60 kA/m in each of ring test pieces of Examples 1 to 7 and Comparative Examples 1 to 6.

Using the above results, FIG. 6 shows a relationship between an applied magnetic field and a magnetic flux density in each of the ring test pieces of Examples 1 to 7 and Comparative Examples 2 to 6. FIG. 7 shows a relationship between μ'L/μ'H and a magnetic flux density B in an applied magnetic field of 60 kA/m in each of the ring test pieces of Examples 1 to 7 and Comparative Examples 1 to 6.

TABLE 6

| | Magnetic Flux Density B (T) | μ'L | μ'H | μ'L/μ'H | μ'24k | μ'24k/μ'L |
|---|---|---|---|---|---|---|
| Example 1 | 1.33 | 45 | 11.1 | 4 | 18 | 0.40 |
| Example 2 | 1.29 | 41 | 10.9 | 4 | 18 | 0.43 |
| Example 3 | 1.63 | 77 | 10.2 | 8 | 18 | 0.24 |
| Example 4 | 1.35 | 48 | 10.4 | 5 | 17 | 0.35 |
| Example 5 | 1.50 | 60 | 10.6 | 6 | 18 | 0.30 |
| Example 6 | 1.30 | 40 | 10.9 | 4 | 18 | 0.44 |
| Example 7 | 1.30 | 40 | 10.8 | 4 | 18 | 0.45 |
| Comparative Example 1 | 1.95 | 151 | 6.5 | 23 | 14 | 0.09 |
| Comparative Example 2 | 2.14 | 210 | 6.6 | 20 | 14 | 0.11 |
| Comparative Example 3 | 2.16 | 32 | 5.9 | 32 | 13 | 0.07 |
| Comparative Example 4 | 0.84 | 2 | 16 | 2 | 12 | 0.71 |
| Comparative Example 5 | 1.03 | 2 | 22 | 2 | 14 | 0.64 |
| Comparative Example 6 | 0.96 | 2 | 22 | 2 | 13 | 0.62 |

[Result 3]

As shown in Table 6 and FIGS. 6 and 7, in the ring test pieces of Comparative Examples 4 to 6, the content of the resin is high, and thus the distance between the soft magnetic particles was increased. As a result, it is considered that the resin was present between the soft magnetic particles, and thus the magnetic flux density in an applied magnetic field of 60 kA/m was lower than that of Examples 1 to 7 and Comparative Examples 1 to 3.

In addition, regarding each of the ring test pieces of Examples 1 to 7 and Comparative Examples 1 to 3, the magnetic flux density in an applied magnetic field of 60 kA/m was secured to be 1.15 or higher. However, in the ring test pieces of Comparative Examples 1 to 3, μ'L/μ'H exceeded 10 unlike in Examples 1 to 7. Therefore, as shown in Result 2, a decrease in differential relative permeability in a high magnetic field is more concerned as compared to Examples 1 to 7.

For a comparison to the technique disclosed in JP 2002-141213 A, Table 6 also shows the values of the first differential relative permeability μ'24 k in an applied magnetic field of 24 kA/m and μ'24 k/μ'L. The magnetic characteristics of the dust core disclosed in JP 2002-141213 A are similar to those of Comparative Examples 4 to 6 of the present application and are clearly different from those of Examples 1 to 7. In addition, it is considered that, as the μ'L/μ'H value of the dust core disclosed in JP 2002-141213 A approaches the values of the ring test pieces of Examples 1 to 7, the magnetic flux density in an applied magnetic field of 60 kA/m is decreased.

<Measurement of Hardness and Thickness>

In the powder for a dust core used in each of the ring test pieces of Examples 1 to 7 and Comparative Examples 1 to 3, the hardness of the soft magnetic particles (base material) and the hardness of the insulating film were measured. Specifically, these materials were treated under the same conditions as shown in Tables 3 to 5 to prepare blocks, respectively. By measuring the hardness of each block using a micro-Vickers hardness meter, the hardness of the soft magnetic particle (base material) and the hardness of the insulating film was obtained. Further, a ratio of the above harnesses (the Vickers hardness of the insulating film/the Vickers hardness of the base material) was calculated. The results are shown in Table 7. Table 7 also shows the magnetic flux density B (T) in an applied magnetic field of 60 kA/m and μ'L/μ'H shown in Table 6.

In the powder for a dust core used in each of the ring test pieces of Examples 2 to 7 and Comparative Example 1 to 3, the thickness of the insulating film was measured using the same method as that of Example 1. The results are shown in Table 7.

Figure 8A:
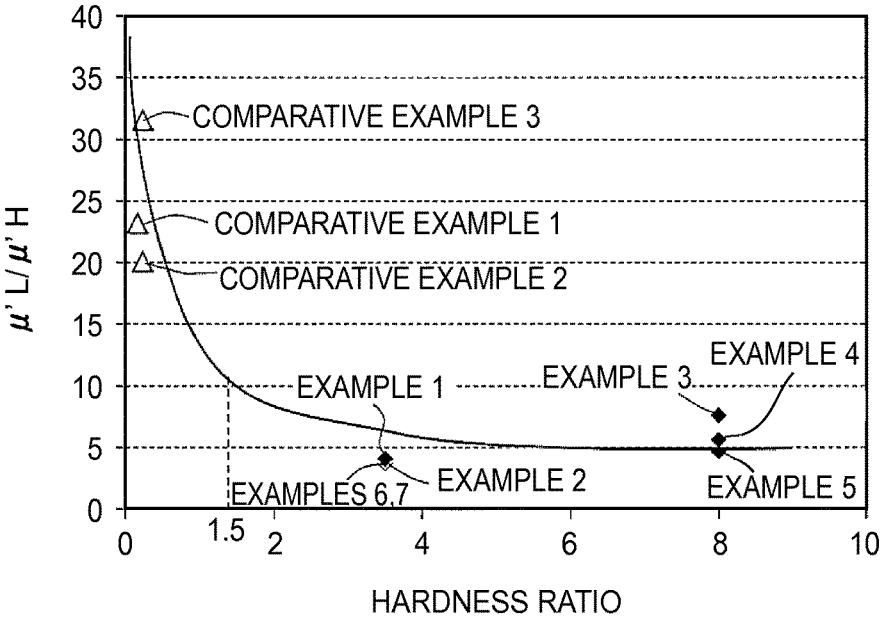
FIG. 8A is a diagram showing a relationship between μ'L/μ'H and a ratio of the hardness of an insulating film of a powder for a dust core used in each of the ring test pieces of Examples 1 to 7 and Comparative Examples 1 to 3.
Figure 8B:
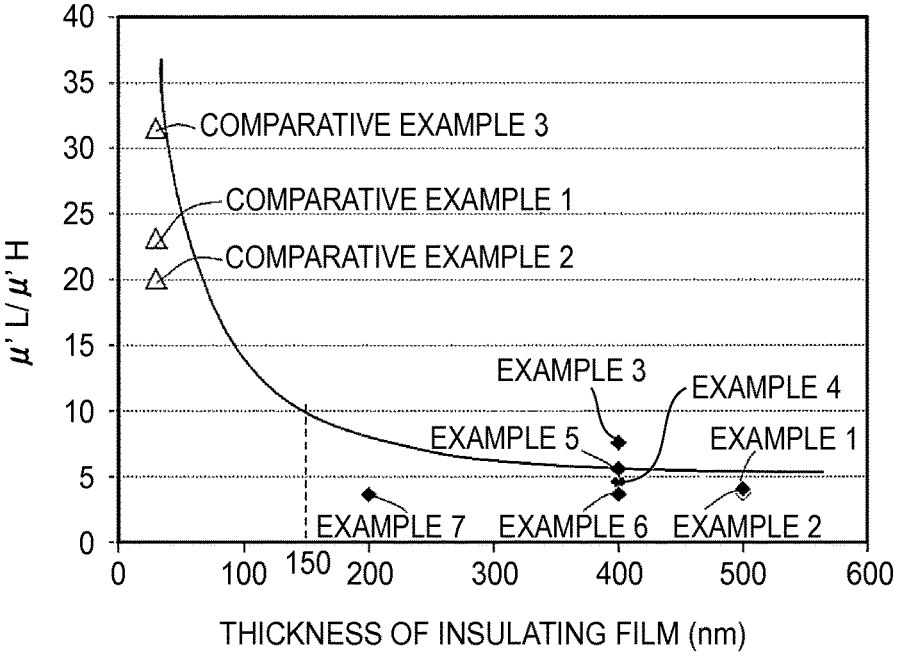
FIG. 8B is a diagram showing a relationship between μ'L/μ'H and the thickness of the insulating film of the powder for a dust core used in each of the ring test pieces of Examples 1 to 7 and Comparative Examples 1 to 3.

Using the above results, FIG. 8A shows a relationship between μ'L/μ'H and the ratio of the hardness of the insulating film of the powder for a dust core used in each of the ring test pieces of Examples 1 to 7 and Comparative Examples 1 to 3. FIG. 8B shows a relationship between μ'L/μ'H and the thickness of the insulating film of the powder for a dust core used in each of the ring test pieces according to Examples 1 to 7 and Comparative Examples 1 to 3.

TABLE 7

| | Magnetic Flux Density B (T) | μ'L/μ'H | Hardness Ratio | Hardness of Base Material (Hv) | Hardness of Insulating Film (Hv) | Thickness (μm) |
|---|---|---|---|---|---|---|
| Example 1 | 1.33 | 4 | 3.5 | 400 | 1400 | 500 |
| Example 2 | 1.29 | 4 | 3.5 | 400 | 1400 | 500 |
| Example 3 | 1.63 | 8 | 8 | 180 | 1400 | 400 |
| Example 4 | 1.35 | 5 | 8 | 180 | 1400 | 400 |
| Example 5 | 1.50 | 6 | 8 | 180 | 1400 | 400 |
| Example 6 | 1.30 | 4 | 3.5 | 400 | 1400 | 400 |
| Example 7 | 1.30 | 4 | 3.5 | 400 | 1400 | 200 |
| Comparative Example 1 | 1.95 | 23 | 0.16 | 190 | 30 | 30 |
| Comparative Example 2 | 2.14 | 20 | 0.23 | 190 | 30 | 30 |
| Comparative Example 3 | 2.16 | 32 | 0.23 | 190 | 30 | 30 |

[Result 4]

As shown in Table 7 and FIG. 8A, when the powders for a dust core of Examples 1 to 7 were used, the μ'L/μ'H values of the ring test pieces were 10 or lower. When the powders for a dust core of Comparative Examples 1 to 3 were used, the μ'L/μ'H values of the ring test pieces were 20 or higher.

The reason is considered to be as follows: since the insulating film of each of the powders for a dust core of Examples 1 to 7 was significantly harder than the soft magnetic powder as the base material, and thus the insulating film was held between the soft magnetic particles during compression forming without being moved. On the other hand, in each of Comparative Examples 1 to 3, the hardness of the insulating film was equivalent to that of the soft magnetic powder as the base material. Therefore, as shown in FIG. 2D, the insulating film was compressed at a triple point of a boundary of the soft magnetic powder. Therefore, it is considered that the μ'L/μ'H values of the ring test pieces were higher than those of Examples 1 to 7. In Table 7, the hardness of the base material and the hardness of the insulating film of Comparative Example 1 were the same as those of Comparative Examples 2 and 3, but the hardness ratios thereof were different from each other. This result is caused by significant digits.

It is presumed from the above results that, when the insulating film has a Vickers hardness which is 1.5 times or higher than that of the soft magnetic particles as shown in FIG. 8B, during compression forming, the movement of the insulating film to the triple point between the soft magnetic particles can be suppressed, and the relationship of μ'L/μ'H≤10 can be satisfied.

Further, in order to secure the above-described characteristics, as shown in Table 7 and FIG. 8, it is preferable that the thickness of the insulating film is 150 nm or more under the condition of the above-described hardness ratio. It is considered that, by securing the thickness of the insulating film, the relationship of μ'L/μ'H≤10 can be secured.

Hereinabove, the embodiment of the invention has been described. However, a specific configuration is not limited to the embodiment, and design changes and the like which are made within a range not departing from the scope of the invention are included in the invention.

What is claimed is:

1. A dust core comprising powder comprising soft magnetic particles each coated with an insulating film, an average particle size of particles constituting the powder for the dust core is 20 μm to 450 μm, the insulating film contains aluminum oxide as a major component, the soft magnetic particles are formed of an iron-aluminum-silicon alloy, in the iron-aluminum-silicon alloy, the Si content is 1 mass % to 7 mass %, the Al content is 1 mass % to 6 mass %, the total content of Si and Al is 1 mass % to 12 mass %, and the balance includes iron and unavoidable impurities, and the insulating film has a Vickers hardness, which is 2.0 times or higher than that of the soft magnetic particles, and has a thickness of 150 nm to 2 μm, wherein the dust core is formed such that, when a differential relative permeability in an applied magnetic field of 100 A/m is represented by a first differential relative permeability μ'L, and when a differential relative permeability in an applied magnetic field of 40 kA/m is represented by a second differential relative permeability μ'H, a ratio of the first differential relative permeability μ'L to the second differential relative permeability μ'H satisfies a relationship of μ'L/μ'H≤10, and a magnetic flux density in an applied magnetic field of 60 kA/m is 1.15 T or higher.

2. A reactor comprising:

a core formed of the dust core according to claim 1; and a coil that is wound around the core.

* * * * *